US005184674A

United States Patent [19]

Keyes

[11] Patent Number: 5,184,674

[45] Date of Patent: Feb. 9, 1993

[54] INNER RIBBED TUBE AND METHOD

[75] Inventor: John M. Keyes, Roseland, Fla.

[73] Assignee: High Performance Tube, Inc., Union, N.J.

[21] Appl. No.: 634,066

[22] Filed: Dec. 26, 1990

[51] Int. Cl.[5] ..... F38F 1/40

[52] U.S. Cl. ..... 165/184; 138/171

[58] Field of Search ..... 165/133, 184; 138/38, 138/170, 171

[56] References Cited

U.S. PATENT DOCUMENTS

| | | | |
|---|---|---|---|
| 1,928,639 | 10/1933 | Berg | 165/184 X |
| 2,817,364 | 12/1957 | Crawford | 138/171 |
| 3,753,364 | 8/1973 | Runyan et al. | 72/71 |
| 4,044,797 | 8/1977 | Fujie et al. | 138/38 |
| 4,164,243 | 8/1979 | Cookson et al. | 138/162 |
| 4,658,892 | 4/1987 | Shinohara et al. | 165/133 |

FOREIGN PATENT DOCUMENTS

| | | | |
|---|---|---|---|
| 111528 | 9/1940 | Australia | 165/184 |
| 1252646 | 8/1986 | U.S.S.R. | 165/184 |

*Primary Examiner*—Allen J. Flanigan
*Attorney, Agent, or Firm*—Ribis, Graham & Curtin

[57] ABSTRACT

A heat exchanger inner spiral ribbed tube and method of manufacture therefor for use in making a refrigerator condenser or a refrigerator evaporator. The tube has an annular wall having an inner surface. The inner surface has a plurality of inner spiral ribs, each having a spiral angle. The spiral angle is between 0 degrees and 90 degrees; and is 45 degrees in the described embodiment. The tube making method includes the steps of swaging a plain plate between a plain roller and a grooved roller to make a ribbed plate; then seam welding the plate at the longitudinal adjacent edges thereof to make the inner spiral ribbed tube.

4 Claims, 2 Drawing Sheets

INNER RIBBED TUBE AND METHOD

The invention generally relates to an inner ribbed tube and method, and in particular the invention relates to a heat exchanger inner spiral ribbed tube and method of manufacture therefor.

BACKGROUND OF THE INVENTION

The prior art inner spiral ribbed tube is described in U.S. Pat. No. 4,705,103 issued No. 10, 1987. Related prior art references include U.S. Pat. Nos.

| | | |
|---|---|---|
| 2,167,933, | issued | February 8, 1938, |
| 3,273,599, | issued | September 20, 1966, |
| 3,753,364, | issued | August 21, 1973, |
| 4,118,944, | issued | October 10, 1978, |
| 4,154,296, | issued | May 15, 1979, |
| 4,658,892, | issued | April 21, 1987, and |
| 4,660,630, | issued | April 28, 1987, and |

also include a related prior art reference paper, which was presented in Atlanta, Ga., USA, at the ITA Meeting, that was held on Oct. 15, 1984, and which is entitled "Internally Grooved Tubes for Air Conditioners", and which explains the prior art method of manufacture.

The prior art inner spiral ribbed tube includes a cylindrical wall having an inner surface, said inner surface having a plurality of inner spiral ribs, said inner spiral ribs each having a spiral angle formed by a tangent to a point on the rib and a longitudinal line through the point and parallel to an elongate axis of the tube, said spiral angle measuring about in the range of 0 degrees to 35 degrees.

One problem with the prior art inner spiral ribbed tube is that the size of its spiral angle is limited. Also, the ratio of rib height to number of ribs is limited, which affects the fluid flow and heat transfer parameters of the tube.

The prior art method of making a heat exchanger for use as a refrigerator condenser or for use as a refrigerator evaporator includes the steps of: making a coil of inner spiral ribbed tube having a rib spiral angle of about 18 degrees; uncoiling and feeding the inner spiral ribbed tube along an elongate tube axis.

The prior art method of making an inner spiral ribbed tube includes the steps of: positioning a grooved rotary mandrel mounted on an elongate tie rod within a plain surfaced tube having an elongate axis; positioning an outer annular member having a plurality of rotary bearing members opposite the rotary mandrel; applying radically inward forces from the rotary bearing members through the tube to the rotary mandrel and swaging and forming a spiral ribbed tube; and pulling the spiral ribbed tube away from the rotary mandrel along the elongate axis.

One problem with the prior art method of making an inner spiral ribbed tube is that the spiral angle has to be low enough, such as about 18 degrees, to prevent the tube from being held by the rotary mandrel, resulting in a breaking of the tube. Another problem is that the friction created limits the height of the rib on the inside of the tube; and limits the number of ribs per unit tube length that can be made. A further problem is that the operation is very slow in three part speed and thus high in production costs. Tooling is costly and limited in tool life.

SUMMARY OF THE INVENTION

According to the present invention, an inner spiral ribbed tube and method of manufacture are provided. This tube includes a cylindrical wall having an inner surface, said inner surface having a plurality of inner spiral ribs, said inner spiral ribs each having a spiral angle formed by a tangent to a point on the rib and a longitudinal line through the point and parallel to an elongate axis of the tube, said spiral angle measuring substantially more than 35 degrees. The method of manufacture of an inner spiral ribbed tube according to the invention includes the steps of: swaging a plain flat plate between a plain roller and a spiral grooved roller to form diagonal ribs on an inner plate surface; forming the ribbed plate into a tubular shape having elongate adjacent edges; making a longitudinal seam weld between the elongate adjacent edges, and urging the spiral ribbed tube along an elongate tube axis.

By swaging a plain flat plate between a plain roller and a spiral grooved roller, and by forming and welding the ribbed plate into a welded tube, a spiral angle of substantially more than 35 degrees can be provided, and a range of spiral angle between 0 degrees and 90 degrees can be provided.

The foregoing and other objects, features and advantages will be apparent from the following description of the preferred embodiment of the invention as illustrated in the accompanying drawing.

DESCRIPTION OF THE PREFERRED EMBODIMENT

Figure 1:
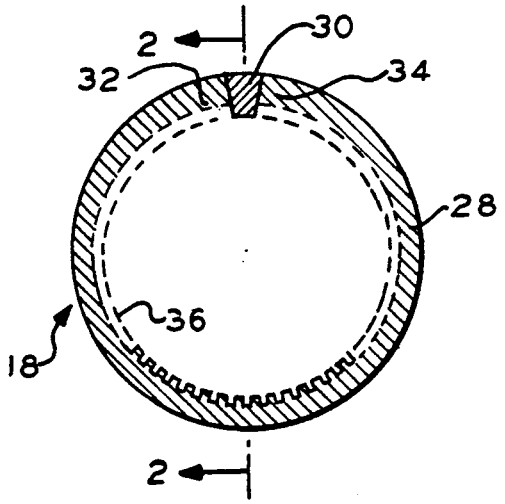
FIG. 1 is a section view of the proposed tube.

As shown in, 3, 6 and 7 tube 18 has a wall 28, which has a longitudinal seam weld or butt weld 30. Wall 28 has a left thickened wall portion 32, and a right thickened wall portion 34, which are disposed adjacent to weld 30. Wall 28 also has an inner surface 36, which has a plurality of helical ribs or spiral ribs 38. Ribs 38 have grooves 40 disposed therebetween. Rib 38 has a helix angle or spiral angle or pitch angle 42. Angle 42, in this embodiment, is about 45 degrees in other embodiments.

Figure 2:
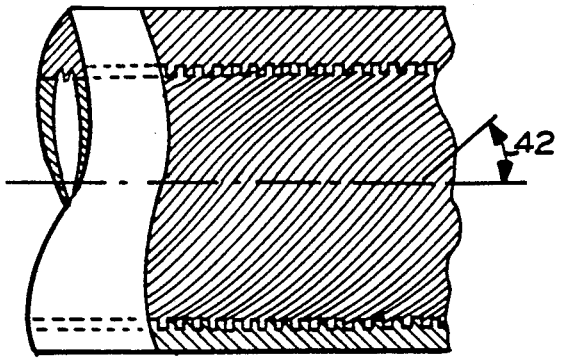
FIG. 2 is a section view along line 3—3 of FIG. 1.
Figure 3:
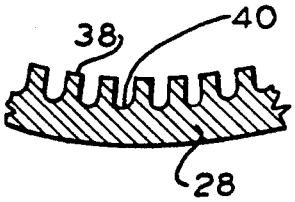
FIG. 3 is an enlarged view of a portion of FIG. 1.

In this embodiment, tube 18 has an outer diameter of about 0.375 inches. Wall 28 has a thickness of about 0.016 inches which includes the height of rib 38. Rib 38 is about 0.008 inches in height. Tube 18 is composed of a copper material. Thickened rib portions 32, 34 each measures about 0.024 inches in thickness, or about 50 percent more than the thickness of wall 28. Inner surface 36, in section, has 60 ribs. In FIGS. 1 and 2, fewer than 60 ribs are shown for ease of illustration.

Figure 4:
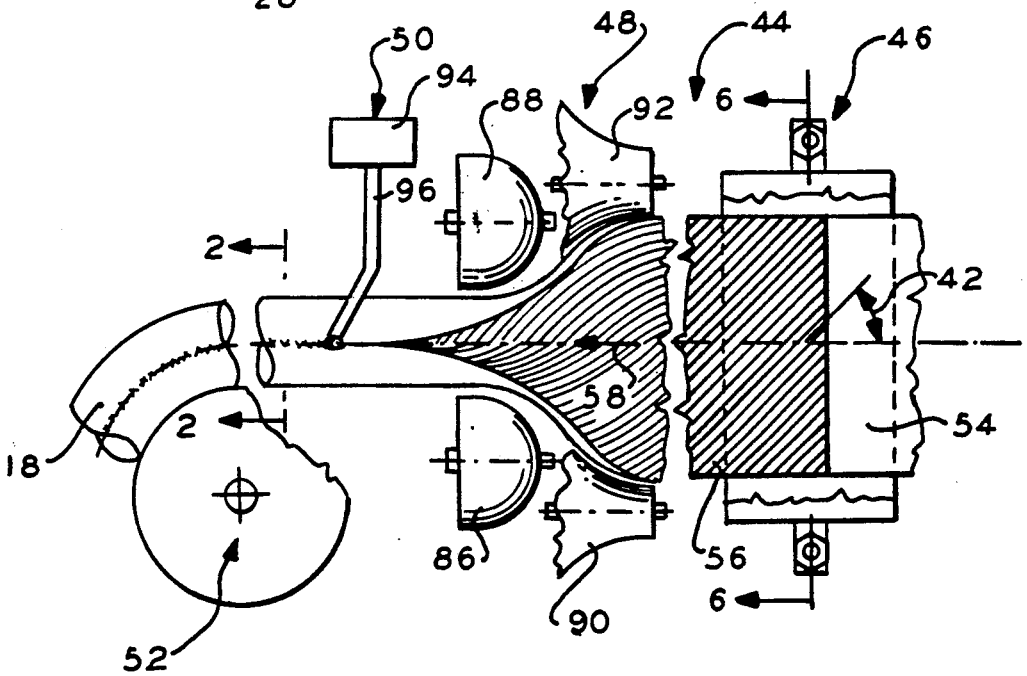
FIG. 4 is a plan view of apparatus for making an inner spiral ribbed tube.
Figure 5:
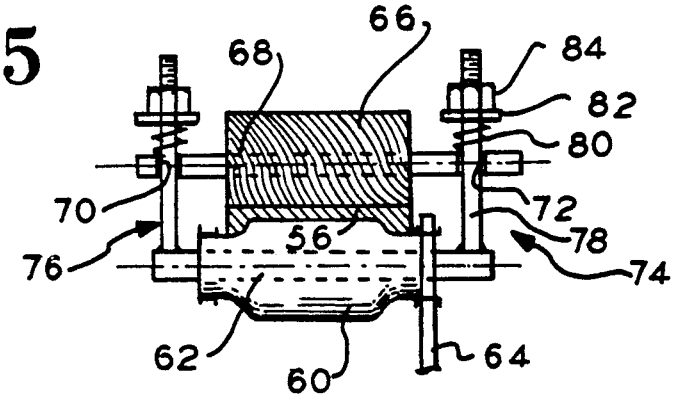
FIG. 5 is section view taken along line 6—6 of FIG. 4.
Figure 6:
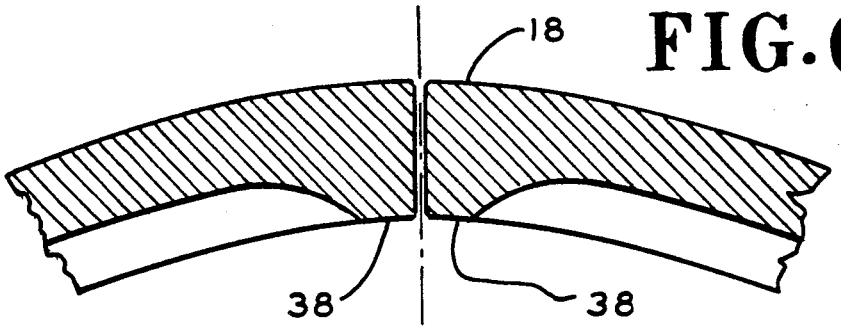
FIG. 6 is a section view showing the edges of the sheet prior to welding with the discontinuous loops at the seam weld.
Figure 7:
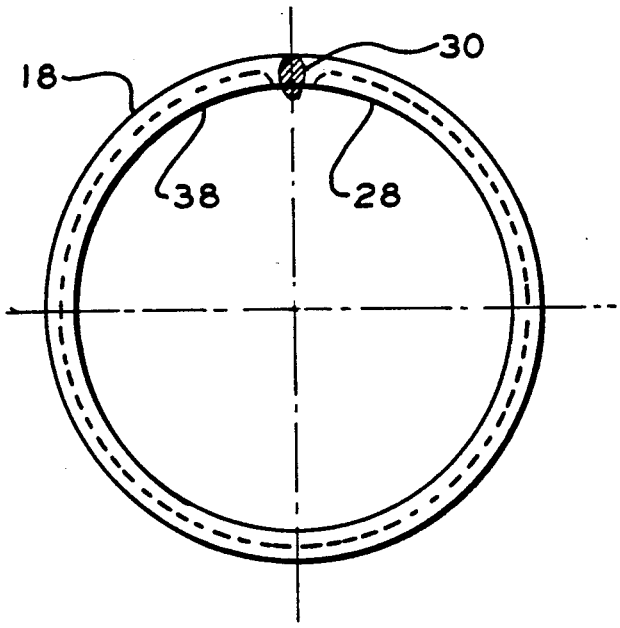
FIG. 7 is a cross section of a tube showing the welded seam and the discontinuous loops at the seam weld.

As shown in FIGS. 4 and 5, a tube making apparatus 44 is provided. Apparatus 44 has a swaging unit 46, a forming unit 48, a welding unit 50, and a coil winding unit 52. Swaging unit 46 receives and acts on a plain plate or strip 54, and forms a ribbed plate 56, which has a direction of travel 58. Swaging unit 46 has a lower plain swaging roller 60, which rotates relative to lower fixed shaft 62. Swaging unit 46 also has an upper grooved swaging roller 66, which rotates relative to an upper fixed shaft 68 that has respective end holes 70, 72. Swaging unit 46 also has two load applying devices 74, 76, which are identical. Device 74 has a threaded rod 78, which is welded to lower shaft 62, by high frequency welding, and which passes through hole 72. Device 74 also has a coil spring 80, a washer 82, and a nut 84. Tightening of nuts 84 of devices 74, 76 caused rollers 60, 66 to apply equal and opposite normal forces on plate 56 urging it towards forming unit 48.

Forming unit 48 has left and right convex forming rollers 86, 88; and has left and right concave forming rollers 90, 92. Rollers 86, 88, 90, 92 bend plate 56 into a cylindrical shape, and position edge portions 32, 34 opposite to each other.

The tube is made in a method of manufacture or process which includes the steps of:

making an inner spiral ribbed tube 56 having a spiral angle 42 measuring substantially more than 35 degrees;

Tube 18 is made in a method of manufacture or process which includes the steps of:

swaging a plain flat plate between a plain roller and a spiral grooves roller to form selectively shaped spiral ribs on a surface thereof;

forming the ribbed plate into an inner spiral ribbed tubular plate having adjacent elongate thickened edge portion; and welding as a longitudinal seam weld said adjacent edge portions.

In addition, tube 18 may be formed into a convenient size core for shipping to an exchanger making plant. The advantages of tube 18 are indicated hereafter.

A) Tube 18 has a spiral angle of about 45 degrees.

B) Rib 38 has a ratio of rib height to number of ribs which is better for tube design than the corresponding ratio of the prior art tube.

C) The method of manufacture can have a possible welding speed of as much as 600 feet per minute or more.

D) Tube 18 has a tube heat transfer rate which is better for tube design than the prior art tube heat transfer rate.

While the invention has been described in its preferred embodiment, it is to be understood that the words which have been used are words of description rather than limitation and that changes may be made within the purview of the appended claims without departing from the true scope and spirit of the invention in its broader aspects.

For example, before forming the tubular shape of the plate 56, a relatively wide plain plate can be embossed or swaged to form ribs thereon, and then the plate can be slit longitudinally to form a plate like ribbed plate 56.

As another example, in the apparatus 44 in FIG. 5, a tube annealing unit can be placed between welding unit 50 and coil forming unit 52.

As still another example, the apparatus 44 of FIG. 5 can be coaxially aligned with the equipment 98 of FIG. 5. Also, the unwinding unit of FIG. 5 can be eliminated.

What is claimed is:

1. A seam welded tube for use in making a refrigerator condenser or a refrigerator evaporator comprising:

an annular wall having an inner surface and an elongate axis;

said inner surface having a series of axially spaced inner spiral rib loops;

said inner spiral rib loops each having a spiral angle formed by a tangent to a point on the rib loop and a longitudinal line through the point and parallel to the elongate axis of the tube;

said spiral angle having a size in the range between zero degrees and 90 degrees;

said tube annular wall having adjacent elongate wall portions extending substantially parallel to the elongate axis, and said elongate wall portions having an elongate seam weld therebetween; and said loops being discontinuous at the seam weld.

2. The tube of claim 1, wherein the elongate wall portions are thickened wall portions.

3. The tube of claim 1, wherein the spiral angle has a size in the range between 35 degrees and 90 degrees.

4. The tube of claim 3, wherein the spiral angle has a size of about 45 degrees.

* * * * *